United States Patent [19]

Bechler et al.

[11] Patent Number: 4,756,484

[45] Date of Patent: Jul. 12, 1988

[54] VERTICAL SHAFT IMPACT CRUSHER WITH INTERCHANGEABLE CRUSHER RING SEGMENTS

[75] Inventors: David J. Bechler, Menomonee Falls; Stephen R. Butts, Greenfield, both of Wis.

[73] Assignee: Nordberg, Inc., Milwaukee, Wis.

[21] Appl. No.: 85,277

[22] Filed: Aug. 10, 1987

Related U.S. Application Data

[63] Continuation of Ser. No. 909,662, Sep. 22, 1986, abandoned.

[51] Int. Cl.[4] ..... B02C 19/00

[52] U.S. Cl. ..... 241/275

[58] Field of Search ..... 241/275, 285 R, 299

[56] References Cited

U.S. PATENT DOCUMENTS

| | | | |
|---|---|---|---|
| 2,992,784 | 7/1961 | Behnke et al. | 241/275 |
| 3,088,685 | 5/1963 | Bridgewater | 241/275 X |
| 3,170,645 | 2/1965 | Behnke et al. | 241/275 |
| 3,180,582 | 4/1965 | Danyluke | 241/275 |
| 3,300,152 | 1/1967 | Behnke et al. | 241/275 |
| 3,540,667 | 11/1970 | Parker | 241/275 |
| 3,578,254 | 5/1971 | Wood | 241/275 |
| 4,560,113 | 12/1985 | Szalanski | 241/275 |

*Primary Examiner*—Carl E. Hall
*Assistant Examiner*—Joseph M. Gorski
*Attorney, Agent, or Firm*—Lawrence J. Crain

[57] ABSTRACT

A vertical shaft impact crusher is provided comprising a housing, a rotor mounted within the housing for rotation about a vertical axis and propelling incoming rock outwardly against a crusher ring, wherein the crusher ring is comprised of segments each capable of autogenous, impact or semi-autogenous crushing or combinations thereof in order to precisely control the size and shape of crushed products.

17 Claims, 5 Drawing Sheets

VERTICAL SHAFT IMPACT CRUSHER WITH INTERCHANGEABLE CRUSHER RING SEGMENTS

This application is a continuation of U.S. patent application Ser. No. 06/909,662, filed 9/22/86, now abandoned.

BACKGROUND OF THE INVENTION

The present invention relates to vertical shaft impact crushers, and more particularly to a vertical shaft impact crusher capable of autogenous, semi-autogenous, or impact crushing.

Impact crushers operate on the principal of accelerating the rock to a high speed and causing it to impact against a target which will cause the rock to fracture. There are essentially two types of impact crushers: autogenous impact crushers and anvil impact crushers. The autogenous variety uses a bed of the same material that is being broken or crushed as the target area so that the rock which is accelerated impacts against other rock of the same type. Anvil type impact crushers utilize a hard block of material such as manganese steel as the target area.

The autogenous and anvil types of impact crushers are used for different purposes. Autogenous crushing is used primarily for reshaping rock which is already approximately the right size. It is most frequently used on wash gravel or natural rock which is smooth and needs to be reshaped with flat faces so that it can be used as aggregate in concrete and the like. Autogenous crushing also produces a large number of fines, so that most of the product of autogenous breaking or crushing is at the two extreme ends of the product size spectrum. However, this crushing medium requires higher rotor tip velocities to achieve desirable reduction ratios. Higher rotor speeds increase horsepower requirements and substantially increase rotor wear.

Anvil breaking, on the other hand, produces a shattering action on the rock so that the majority of the product is near the central region of the product size distribution spectrum. Anvil breaking is used primarily to reduce the size of the input rock rather than to reshape rock which is already approximately the correct size. The anvil crushing ring thus generates higher reduction ratios at slower tip velocities, but does not generate a product shape of comparable quality to the autogenous apparatus, commonly known as the "rock box." The anvil ring reduces horsepower requirements and minimizes rotor wear by allowing for slower rotor speeds.

Impact rock crushers are often mounted on trailers for transportation from site to site, so that rock may be crushed at the location where it is needed. However, in the past, it has been necessary to use an autogenous crusher for autogenous crushing and to use an anvil crusher for anvil crushing. One solution to this problem is disclosed in commonly-assigned U.S. Pat. No. 4,560,113, where a vertical shaft impact crusher is provided with a pair of interchangeable breaker rings; one having anvils for impact crushing, and the other with a rock box for autogenous crushing. Thus, in this case the operator has a choice of performing either shaping or size reduction, but not a combination of both.

Thus, there has been a need for a vertical shaft impact crusher which is capable of adjusting or fine tuning the crushing process to more accurately control the size and shape of the crushed product.

It is therefore an object of the present invention to provide a vertical shaft impact crusher capable of autogenous, impact and/or semi-autogenous crushing simultaneously to produce a product of controlled shape and size.

It is a further object of the present invention to produce desired product at a desired volume at lower rotor velocities in order to reduce rotor tip wear and horsepower requirements.

SUMMARY OF THE INVENTION

The objects of the present invention are embodied in a vertical shaft impact crusher provided with a crushing ring comprised of alternating autogenous, impact and/or semi-autogenous crushing portions, the specific sequencing and arrangement of which allows the operator to precisely determine the size and shape of the crushed product.

More specifically, the present invention is comprised of a vertical shaft impact crusher having a closed housing wherein a supply of rock is fed through a hopper into the axis of a rotating impeller or rotor. The rotor propels the rock outwardly against a crushing ring located on the inside periphery of the housing. Where traditional vertical impact crushers were provided with crushing rings designed exclusively for impact, autogenous, or semi-autogenous crushing, the present crusher is provided with a crushing ring which includes segmented interchangeable and alternating crushing portions, each portion designed for one of the three types of crushing mentioned above.

The impact crushing portions are comprised of at least one anvil, each of which is mounted to the crushing ring by means of a specialized mounting bracket. The mounting brackets allow rotation of the anvil head to equalize wear. The anvil brackets are located around the entire periphery of the crusher ring to allow total flexibility of anvil placement.

The autogenous crushing portions are comprised of a shelf-like plate extending horizontally toward the rotor from the housing's inner wall. These plates are located below the anvil brackets and are designed to accumulate a bed of crushed rock which will become the autogenous crushing surface.

The crushing ring is designed so that when desired, any of the autogenous plates can be removed, and anvils placed in the brackets to convert from autogenous to anvil crushing. Similarly, if semi-autogenous crushing is desired, both anvils and autogenous plates may be placed in the same ring segment.

DESCRIPTION OF THE DRAWINGS

The invention and its many attendant objects and advantages will become more apparent upon reading the following description of the preferred embodiment in conjunction with the following drawings, wherein.

DESCRIPTION OF THE PREFERRED EMBODIMENT

Figure 1:
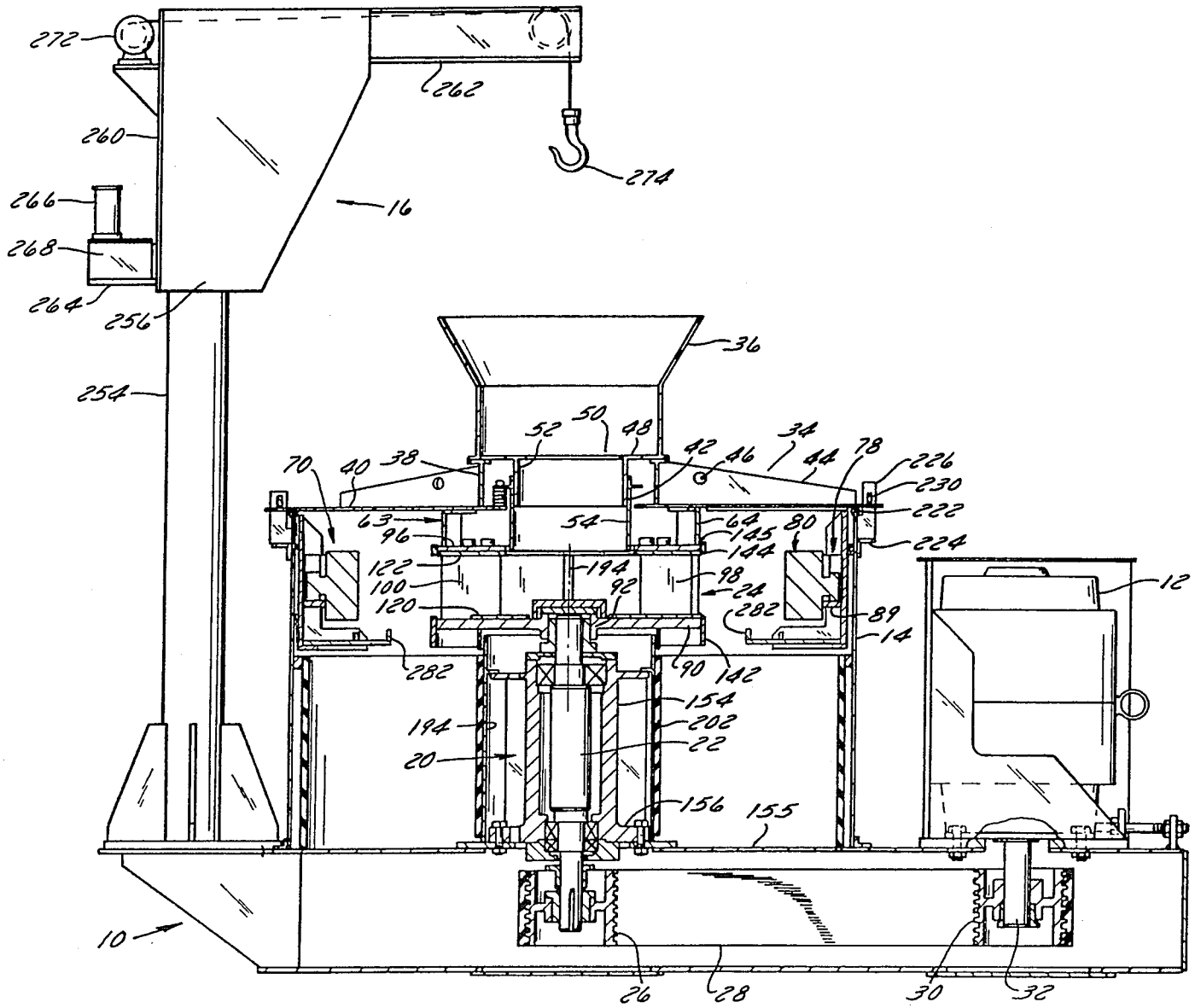
FIG. 1 is a sectional elevation of the vertical shaft impact crusher made in accordance with this invention.
Figure 2:
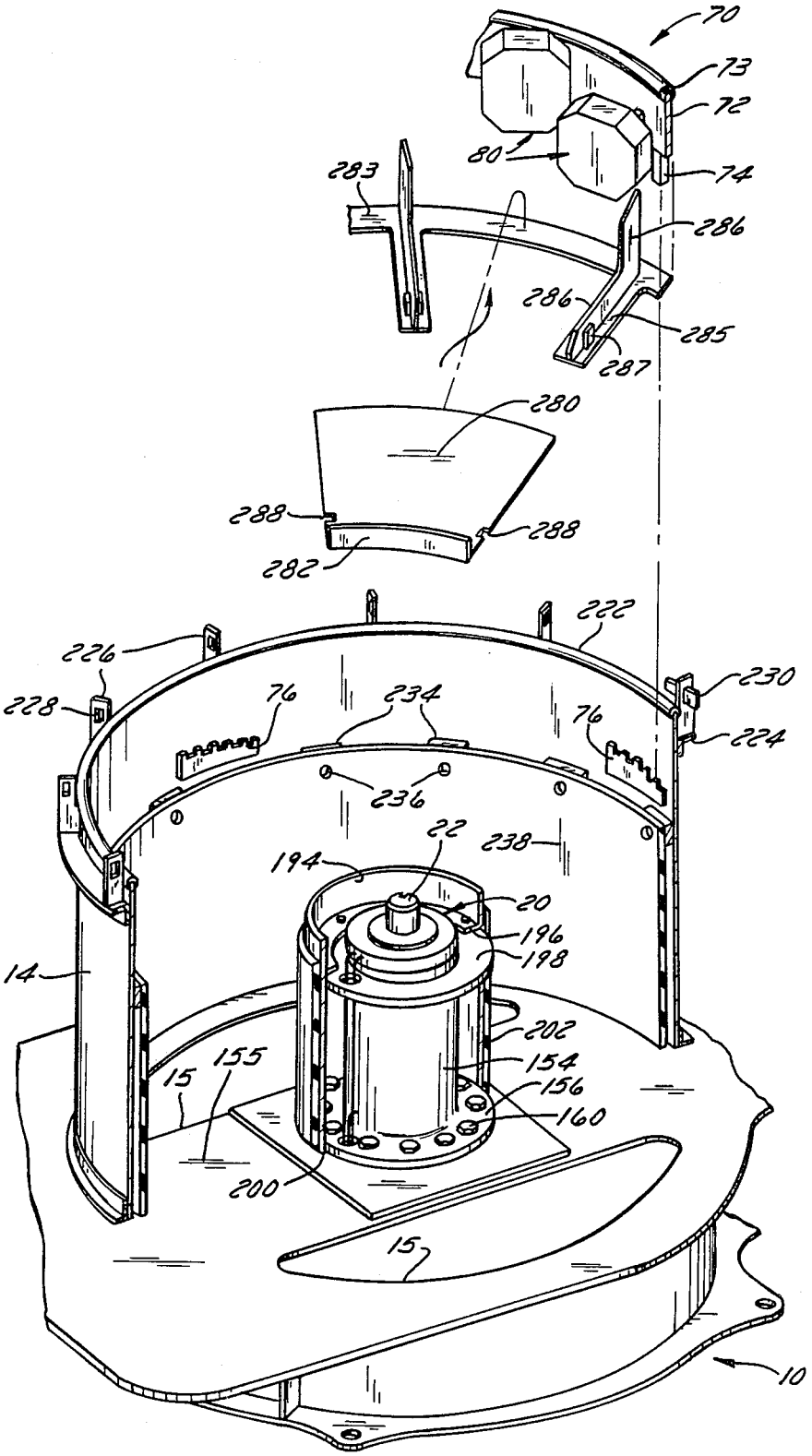
FIG. 2 is a partial sectional perspective of the vertical shaft impact crusher shown in FIG. 1 with the cover and rotor removed and a fragment of the crusher ring exploded out of the machine.

Referring now to the drawings, wherein like reference characters designate identical or corresponding parts, and more particularly to FIGS. 1 and 2, a vertical shaft impact crusher according to the present invention includes a frame 10 on which is mounted a drive motor 12, a crusher housing 14 bolted to the frame concentrically around a pair of segmental openings 15 therethrough and a crane 16. A bearing cartridge 20 is also mounted directly to the frame 10 coaxially within the crusher housing 14. The bearing cartridge 20 supports for rotation about a vertical axis a shaft 22 which has mounted on its top end a rotor 24 and mounted on its lower end, a sheave 26 which is connected by way of a drive belt 28 to a corresponding sheave 30 mounted on the lower end of the motor shaft 32.

A cover 34 is mounted on top of the crusher housing 14 and includes a feed tunnel 36 mounted on a collar 38 which is welded to a cover plate 40 concentrically with a central hole 42 and the cover plate 40. A series of radially extending tapered braces 44 are welded to the collar 38 and to the cover plate 40 to strengthen the cover and provide, by virtue of holes 46 in the braces 44, means for attaching a hoist cable from the crane 16 when it is desired to lift the cover off of the crusher housing 14.

The feed tunnel 36 has a floor plate 48 having a central opening 50. A feed tube 52 is welded to the underside of the floor plate 48 and depends therefrom to a level approximately equal to that of the cover plate 40. A replaceable feed tube extension 54 is telescopically disposed around the feed tube 52 and is provided with an extension adjustment mechanism for adjusting the length of its extension through the hole 42 in the cover plate 40.

A guard shell 63 made of a series of shell segments 64 is bolted to the underside of the cover plate 40 concentrically around the central hole 42. The shell segments are arcuate in form and include an inwardly extending upper flange by which the segments 64 are bolted to the cover plate. The liner segments 64 protect the top of the rotor 24 from damage by broken rock bouncing off of a crusher ring 70 mounted in the crusher housing 14 as as to be horizontally aligned with the rotor 24.

The crusher ring 70 shown in FIG. 1 and shown in greater detail in FIGS. 2–6 includes an annular hoop 72 of heavy steel construction having an annular seal 73 fastened to its top surface for sealing space between the hoop 72 and the crusher housing 14. Three or four depending vertical legs 74 are welded to the underside of the hoop 72 at equally spaced annular positions around the hoop. The exact number of legs will be determined by the load capacity of the ring 70. The legs 74 are supported by a like number of stepped mounting blocks 76 welded to the inside of the crusher housing 14, as shown most clearly in FIG. 2. The support blocks 76 have a plurality of steps formed thereon at different angular positions and elevations to provide a plurality of elevation settings for the crusher ring. This enables the elevation of the crusher ring to be adjusted within crusher housing 14 so that the vertical position of the crusher ring relative to the rotor can be optimized for optimal crushing efficiency and use of material, as explained more fully below.

The crusher ring 70 has welded thereon a series of brackets 78, each having two legs 77 fastened to and extending inwardly from the hoop 72 on a secant to the circle defined by the hoop. A cross arm 79 is welded to and extends between the outside end of each pair of legs 77 and has a vertical slot 81 completely through the arm 79. The cross arm 79 is actually made of two separate pieces, one each welded to the end of each leg 77. Three lifting lugs 75 are welded to three legs 77 at equally spaced angular positions around the crusher ring for attachment of a cable to hoist the crusher ring in and out of the housing 14.

Figure 3:
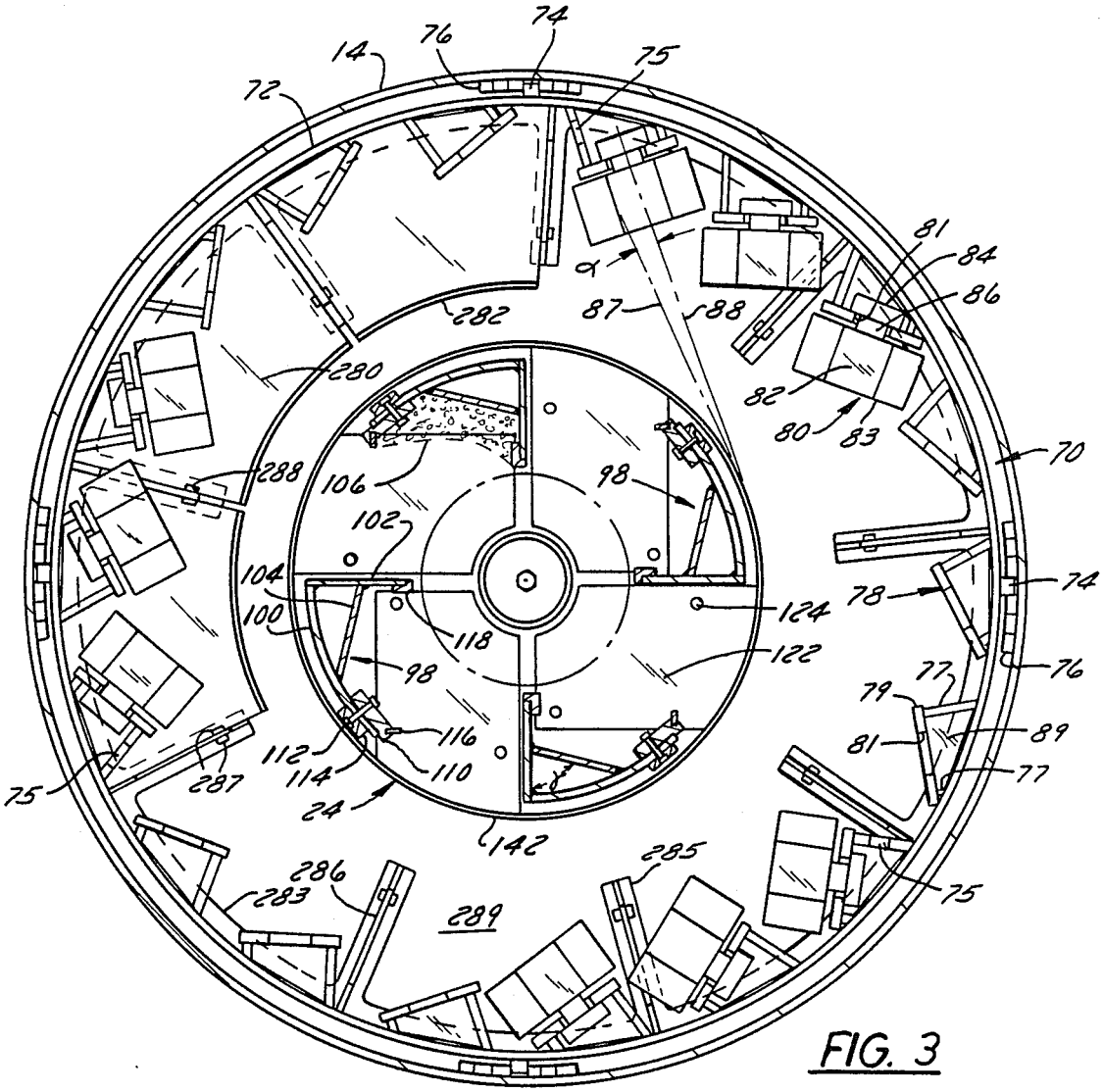
FIG. 3 is a plan view of the rotor and crusher ring of the present invention wherein a combination of autogenous, impact and semi-autogenous crushing may be performed.
Figure 3A:
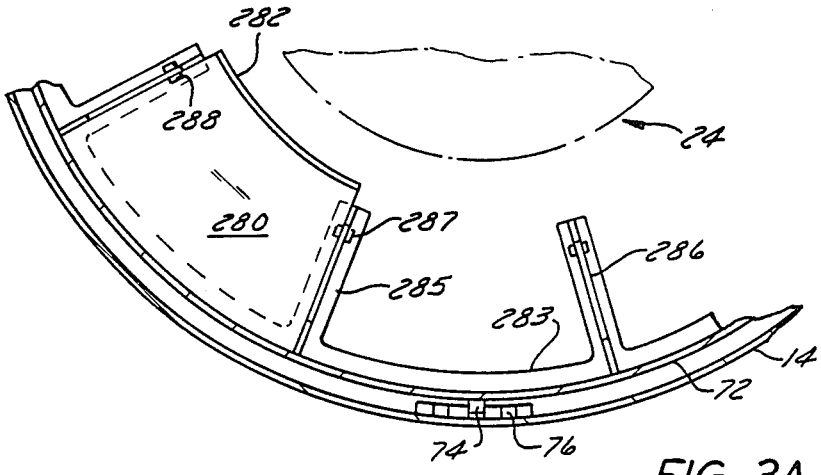
FIG. 3A is an enlarged plan view of a portion of the crusher ring of the present invention depicted in FIG. 3 with the anvil brackets removed.

Each bracket 78 may support an anvil 80. Each anvil 80 includes an octagonal head 82 having a flat octagonal face 83, a square foot 84, and square neck 86 connecting the head 82 and the foot 84. The head, foot and neck of the anvil 80 are symmetrical about a horizontal axis 88 forming an angle with a tangent 87 of the rotor through the anvil of about 5°–15°, with 10° being preferred as shown in FIG. 3. This angle represents the radial component of velocity exerted by the rotor on the rock as it is propelled from the rotor. The radial component of velocity is a function of the rotor pocket face angle, as discussed below.

Each anvil 80 is supported on a bracket 78 by lowering the anvil neck 86 into the slot 81 in the cross arm 79 until the anvil foot 84 contacts a support plate 89 welded to the bottom of the bracket legs 77 and cross arm 79. The support plates 89 support the vertical weight of the anvil 80 and also rigidify the brackets 78.

The brackets 78 are welded from simple flame cut pieces for great economy and precision of manufacture, and also great strength. The pieces all overlap each other slightly to provide a convenient and economical outside rabbets in which the pieces can be quickly and securely welded. The structure is so open and accessible that it is particularly suitable for automatic welding operations.

The octagonal faces 83 of the anvil heads 82 represent an efficient utilization of anvil material, since the corners of a square or rectangular anvil are not impacted by rock in a centrifugal impact crusher of the present design. The octagonal face is symmetrical about the axis 88 of the anvil so that the anvil may be rotated by multiples of 90° without changing the pattern of anvil faces presented to the rotor 24. It is thus possible to maintain a substantially uniform and consistent anvil array throughout the useful life of the anvil. The support blocks 76, spaced at equal angular positions around the crusher housing 14, enable the crusher ring 70 to be rotated to as many positions as there are support blocks 76, four being disclosed herein. In practice, the rocks tend to be thrown predominantly in one angular region where they tend to fall into the rotor predominantly toward one side because of the conveyor feeder. Consequently, the anvils 80 in that one angular region tend to wear faster than in other regions. By periodically rotating the breaker ring incrementally, it is thus possible to distribute the anvil wear more evenly.

The rotor, as seen in FIGS. 1 and 3, includes a circular base plate 90 having an axial hub 92 formed integrally on the vertical center line 94 of the rotor. A top plate 96 is disposed vertically above and parallel to the base plate 90 and coaxial therewith. The top plate 96 is held in spaced relationship to the base plate 90 by a series of vertically oriented partitions or plates which form four autogenous pockets 98 spaced equally around the rotor. Each pocket 98 is formed of an arcuate circumferential or peripheral plate 100 and a radial plate 102 welded to the trailing end of the circumferential plate 100 in the sense of the direction of rotation thereof. A pocket floor plate 104 is welded at an angle of about 76° between the radial plate 102 and the arcuate plate 100. The angle is selected to lie approximately parallel to the top face 106 of the dirt and rock bed which collects and is held in pocket 98 while the machine is in operation, although the angle of face 106 may be adjustable by the technique disclosed below. The pocket floor plate 104 reduces the mass of the rock in the pocket to minimize the severity of the imbalance if one rock bed becomes dislodged.

The leading edge of each arcuate plate 100, on the end remote from the end to which the radial plate 102 is connected, has attached thereto a wear resistant bar 110. The wear resistant bar 110 is attached to the leading edge of the arcuate plate 100 by two bolts 112 which pass through a back-up bar 114 on the outside of the arcuate plate 100 to protect the bolts 112 from erosion by broken rock ricocheting off the anvils 80. The leading inside edge of the wear resistant bar 110 includes a slot in which is fixed, as by silver soldering, a piece of hard, wear resistant material 116 such as silicon carbide.

The radial inside edge of the radial plate 102 is protected from erosion by a wear bar 118. The wear bar 118 is an L-shaped member which is held in place on the radial plate 102 by tack welding and is removed by burning through the tack weld with a torch. The wear bar 118 is made of a high chrome steel and does not require the silicon carbide insert as used in the wear bar 110 because the wear bar 118 is much closer to the axis of the rotor than the wear bar 110, so it is not subjected to the same degree of erosive action that the wear bar 110 experiences as rocks are accelerated off its feeding edge.

The angle selected for the face 106 of the rock bed in the pocket 98 is controlled by the length of the radial plate 102 and the effective length of the peripheral arcuate plate 100. The effective length of both plates can be varied by the use of different wear bars 110 and 118 having greater length so they effectively extend past either the radial plate 102 (for a smaller angle of the face of the rock bed) or the arcuate plate 100 (for a greater angle of the rock bed face).

To increase the shattering effect of the rotor itself on the rock, it may be desirable to replace the autogenous rotor pocket structure with conventional cast iron impeller shoes. The rotor 24 of this invention will accommodate the installation of conventional shoes mounted directly to the walls 100, 102 and 104, or could be mounted directly to the rotor base plate 90 in place of the autogenous pocket walls.

A pair of wear plates 120 and 122 is fixed to the rotor base plate 90 and the rotor top plate 96, respectively, in each of the four quadrants of the rotor. The bottom wear plate 120 is fixed to the top surface of the rotor base plate 90 by a pair of bolts 124 which pass through the wear plate 120 and the rotor base plate 90 and are locked into position by suitable locking nuts.

A protective skirt or lower outer guard ring 142 is tack welded around the outside periphery of the rotor base plate 90, projecting vertically slightly above the top surface thereof and vertically below the top surface thereof a distance approximately equal to the thickness of the rotor base plate 90. The skirt 142 protects the edge of the rotor base plate 90 from erosion and also provides a shoulder by which the position of the bottom wear plate 120 can be located for ease of insertion of the mounting bolts when the wear plate 120 is replaced.

A top guard ring or rim 144 is welded to the rotor top plate 96 in the same manner used to weld the protective skirt 142 to the rotor base plate 90. The top of the top rim 144 projects above the top surface of the top plate 96 and forms a shoulder 145 therewith.

The skirt 142 and the top rim 144 provide a prestressed support ring to radially support the wear plates 120 and 122. Under high centrifugal force, the skirt and rim, if not prestressed, could expand slightly and lessen the radial support provided to the wear plates.

The rotor hub 92 is held to the top of the shaft 22 by a conventional key arrangement.

The shaft 22 is supported by a cylindrical bearing cartridge 20 shown best in FIG. 2. A heavy cylindrical cartridge housing 154 is attached to a bridge 155 in the base of frame 10 between the two segmental openings 15 by bolting a lower flange 156, integral with the housing 154 and into which is drilled a plurality of holes to receive bolts 160 by which the bearing cartridge housing 154 is fastened to the frame bridge 155.

A cylindrical dust shell 194 surrounds the bearing cartridge 20 and is supported thereon by a radially inwardly extending flange 196 which is bolted to a radially outwardly extending flange 198 adjacent the top of the cartridge housing 154. A rubber bumper 200 is fitted on the lower end of the dust shell 194 and is slightly compressed between the dust shell and the frame 10 to exclude dust from the bearing cartridge and to dampen vibration and minimize noise. A urethane shield 202 is secured to the outside surface of the dust shell 194 to prevent abrasive damage to the dust shell and also to dampen vibration and minimize noise. The urethane shield 202 may be bolted to the dust shell or may be bonded directly to the shell.

Referring now to FIGS. 1 and 2, the crusher housing 14 is a cylindrical tank having a rubber bumper 222 placed on the top lip of the tank to act as a dust seal and also to dampen vibration and to attenuate noise. An annular bracket 224 is welded around the outside surface of the tank slightly below the top lip and provides a support to which the bottom edge of a plurality of upright locking tongues 226 are welded. Each locking tongue has a rectangular hole 228 punched in its upper end for receiving a lock wedge 230. The cover plate 40 has a series of short radial slots 232 at its outside edge at angular positions corresponding to the angular positions of the locking tongues 226 around the housing 14, so that when the cover is placed on the top of the housing 14 with the locking tongues lined up with the slots 232, the tongues 226 will extend through the slots 232 and the lock wedges 230 may be driven into the holes 228 to lock the cover in place.

A series of spacer blocks 234 is welded on a horizontal line around the inside of the tank just beneath the stepped support block 76. The spacer blocks 234 are each drilled and tapped to accept a bolt 236 which fastens a rubber curtain 238 at its top edge to the spacer blocks. The rubber curtain 238 hangs down to the floor around the full inside circumference of the crusher housing 14. It prevents abrasion of the tank wall and is extremely effective in dampening vibration and noise during operation.

The crusher ring 70 can be removed by attaching a cable hook to each of the three lifting lugs 75 attached to the three bracket legs 77 at equally spaced positions around the annular hoop 72 of the crusher ring 70 and lifting the crusher ring out of the crusher housing 14.

The preceding discussion has described a vertical shaft impact crusher capable of anvil crushing exclusively. Purely autogenous crushers are also well known in the prior art. However, many applications call for a crushed product which is best obtained through a combination of anvil and autogenous crushing. Until the present invention, such a combination was unavailable on a single crushing ring 70.

In the present invention, and referring to FIGS. 2, 3, 3A and 5, autogenous crushing is obtained through the use of at least one removable flat plate 280 which extends on a substantially horizontal plane from the crusher ring 70 towards the rotor 24. Each plate 280 may be provided around its inner periphery with a vertically projecting flange 282 to facilitate the retention of a sufficient quantity of rock to form an autogenous bed 284. The plates 280 are releasably secured to the crusher ring 70 by being placed upon a pair of supporting gusset members 286 and an annular bracket 283. The gussets 286 are constructed and arranged to support two adjacent plates 280. Bracket 283 is provided with radially projecting portions 285 and is secured to the lower edge of the crusher ring 70 to support plate 280. Each gusset 286 is provided with a pair of vertically projecting locating lugs 287 located at the protruding end of gusset 286. Lugs 287 are positioned to engage notches 288 on each lateral edge of plates 280 to locate and position the plates upon crusher ring 70. Plate 280 is thus secured without the use of supplemental fasteners or tools. Once the crusher is in operation, the plates 280 will be secured upon ring 70 by the accumulation of crushed rock which forms the autogenous bed 284.

Figure 4:
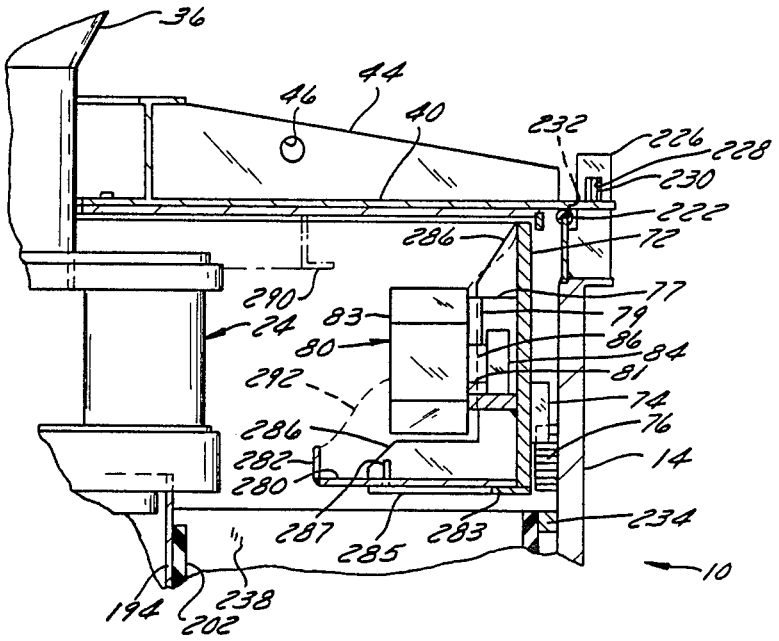
FIG. 4 is a section of one portion of the present crusher ring in the semi-autogenous mode.
Figure 5:
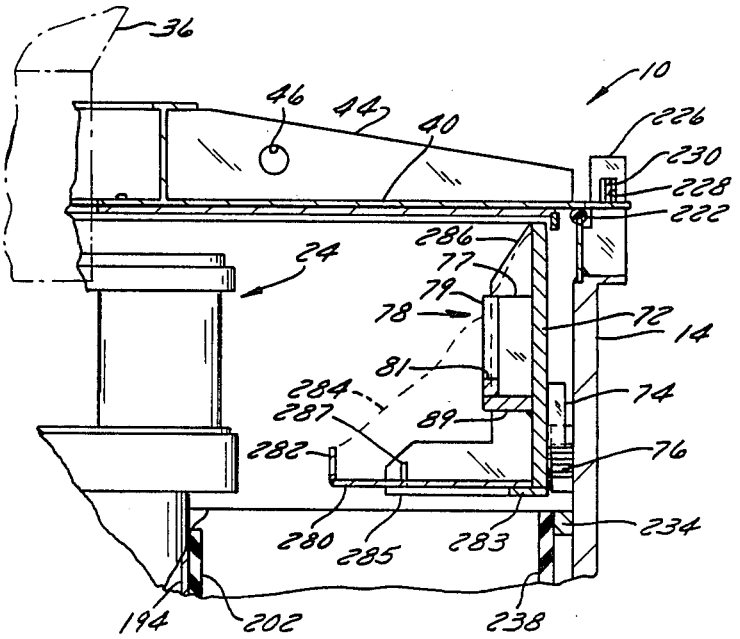
FIG. 5 is a section of a segment of the present crusher ring in the autogenous mode.

In some cases, semi-autogenous crushing may also be desired. As is shown in FIG. 4, the autogenous retention plate 280 is placed in a portion of the crusher ring 70 and is accompanied by an anvil which has been placed in the bracket 78.

Specifically referring to FIG. 3, it can be seen that the radially projecting portions 285 of annular bracket 283 roughly divide the crusher ring 70 into a plurality of segments 289, the number of segments approximating the number of radially projecting portions 285. Each segment 289 may be provided with an anvil 80, a plate 280, both plate and anvil, or neither feature. In addition, groups of adjacent segments may be similarly outfitted to achieve the same crushing characteristics. Furthermore, the crusher ring 70 may be outfitted so that the crushing characteristics of one segment 289 overlap the adjacent segment. For example, in a segment fitted with two anvil brackets 78, an anvil may be placed in only one bracket, and a plate 280 may be included to create a segment with semi-autogenous *and* autogenous characteristics.

Figure 6:
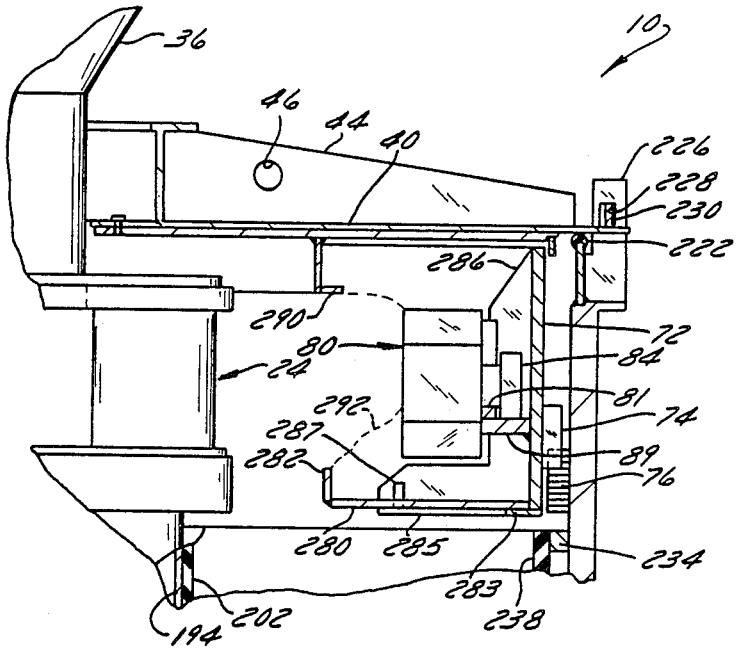
FIG. 6 is a section of a segment of the present crusher ring in the semi-autogenous mode wherein a supplemental annular rock retention ring is provided attached to the inner surface of the top lid.

Referring now to FIG. 6, in order to further cover the anvil with a layer of autogenous rock on its upper surface, the interior of cover plate 40 is provided with an annular, vertically depending ring 290 which, when cover 40 is in place, creates an additional retention area for crushed rock. This annular ring 290 may be provided in segmental form to further adjust the shaping and sizing of the particular products of the crusher. The use of a ring segment 290 is not restricted to those portions containing anvils, but may also be placed over crusher ring portions designed for autogenous and/or semi-autogenous crushing.

The crane 16 includes a support pillar 254 to which a pair of brackets 256 are attached for supporting a crane control box by which the crane 16 is controlled. A bearing (not shown) around the upper portion of the support pillar 254 rotatably supports the upper end of the crane 16 which includes a vertical extension 260 and a cantilevered horizontal arm 262. A support bracket 264 is welded to the lower end of the vertical extension 260 and supports an electric motor 266 coupled to a gear pump 268.

A hydraulic rotation motor (not shown) is coupled between the upper portion of the crane 16 and the support pillar to allow the upper portion of the crane to be rotated about the support pillar. A motorized hydraulic winch 272 allows a hook 274 to be raised or lowered by taking up or playing out cable from a winch drum (not shown).

In operation, rock to be crushed is continuously fed into the feed tunnel 36 and falls through the feed tube 52 and the feed tube extension 54 and into the center of the rotor 24. The rotor rotates at variable speeds on the order of about 900–1800 RPM. The rock is thrown radially outward where it is caught and accelerated by the rotor pockets 98. The rotor pockets soon become covered with a blanket of rock which protects them from erosion by the rock as it is thrown outward. The only surfaces which encounter erosion within the pocket are the wear plates 120 and 122 and the inner and outer wear bars 118 and 110. These wear pieces are all easily and quickly replaceable when they wear down.

The rock is thrown by the pockets 98 outwardly against either the anvil breaker 80, the autogenous bed 284 or the semi-autogenous portion 292. The trajectory of the rock is about 5°–15° out from the tangent to the rotor. The deviation from tangential trajectory is caused by the angle of the rock face within the pocket 98 and the coefficient of friction of the rock-on-rock as the rocks are thrown radially outward. The brackets 78 are set in the crusher ring 70 at an angle such that the faces of the anvils 80 lie perpendicular to the flight trajectory of the rock which is about 10° out of tangent to the rotor. In this way, the rocks will strike the anvil faces exactly perpendicular so that the full momentum of the rock is converted to an internal shattering force and little of the energy is wasted on ricochet force. The broken rock then falls vertically downward between the rubber curtain 238 and the dust shell 194 and through the openings 15 on the two sides of the cartridge support bridge 155. The rock is then carried away by suitable conveyor means (not shown).

Faced with very specific product needs, the crusher operator will determine the desired combination of anvil, autogenous bed, or semi-autogenous crushing characteristics to create the most desirable product. The crusher ring segments 290 are then assembled so as to have the desired combination of characteristics by removing or combining anvils 80 with plates 280, and/or lid segments 290, as is shown in FIG. 3. If desired, a totally autogenous, totally semi-autogenous or totally impact breaker type crusher ring may also be provided.

Obviously, numerous modifications and variations of the above-described preferred embodiment will occur to those skilled in the art in light of this disclosure. Accordingly, it is expressly to be understood that these modifications and variations, and the equivalents thereof, may be practiced while remaining within the spirit and scope of this invention as defined in the following claims.

What is claimed is:

1. A vertical haft impact crusher comprising:

a housing having an outside surface, an inside surface and a cover plate with an underside; a rotor mounted within said housing for rotation about a central vertical axis and designed to receive axially fed rock and propel it outwardly towards the inside surface of said housing;

means for feeding said rock to the axial center of said rotor;

means for rotating said rotor about said axis;

an annular crusher ring releasably and adjustably mounted to said inside surface of said housing on a substantially horizontal plane with said rotor to receive and fragment said rock propelled by said rotor, said crusher ring defining a circle and being comprised of segments, each of said segments comprising means for selective formation into crusher ring portions specifically intended for either autogeneous crushing, impact crushing, semi-autogenous crushing, or combinations thereof, said means including:

an anvil bracket provided on each of said segments, each of said brackets having at least one leg having two ends, each of said at least one leg being fastened at one end to and extending inwardly from said ring on a secant to the circle defined by said ring, each said second end being connected to a notched cross arm; and an autogenous plate retaining bracket provided on each of said segments, each of said plate retaining brackets having an annular portion and a pair of spaced inwardly projecting radial portions, each of said projecting portions being supported by a vertically projecting gusset secured along a vertical edge thereof to said ring.

2. The vertical shaft impact crusher described in claim 1 wherein said underside of said cover plate is provided with a vertically-depending annular ring positioned to facilitate the deposition of crushed rock above said anvil brackets.

3. The vertical shaft impact crusher described in claim 1 wherein said segments comprise autogenous and impact crushing portions arrayed around said crushing ring.

4. The vertical shaft impact crusher described in claim 6 wherein said autogenous and impact crushing portions alternate on a regular basis.

5. The vertical shaft impact crusher described in claim 6 wherein said autogenous crushing and impact crushing portions are of approximate equal length.

6. A vertical shaft impact crusher for crushing rock or minerals, comprising;

a housing having an outside surface, an inside surface and a cover plate with an underside provided with a vertically depending annular ring;

a rotor mounted within said housing for rotation about a central vertical axis and designed to receive axially-fed rock and propel it outwardly towards the inside surface of said housing;

means for rotating said rotor about said axis;

an annular crusher ring releasably and adjustably mounted to the inside surface of said housing, said crusher ring defining a circle;

a plurality of impact breaker anvil brackets secured to and positioned around said crusher ring, each of said brackets having at least one leg having two ends, each of said at least one leg being fastened at one end to and extending inwardly from said crusher ring on a secant to the circle defined by said crusher ring, each said second end being connected to a notched cross arm;

a plurality of impact breaker anvils removably positioned in a select number of said cross arm notches to receive and fragment rock thrown by said rotor;

a plurality of autogenous plate retaining brackets secured to and regularly spaced about said crusher ring beneath said anvil brackets, each of said plate retaining brackets including a pair of spaced, inwardly projecting radial portions, each of said portions being supported by a vertically projecting gusset having an inside and an outside, and a pair of vertically projecting locating lugs, each said gusset being secured along a vertical edge thereof to said ring;

a plurality of substantially planar autogenous plates, each having an inner peripheral edge with an upwardly projecting lip, and an underside and being releasably secured to said crusher ring by said plate retaining brackets between the insides of adjacent gussets and in a selected radially inwardly projecting orientation to form at least one rock-retaining ledge segment beneath said anvil brackets which, when filled with rock, performs autogenous crushing;

wherein the selected sequence of autogenous plates and breaker anvils around said ring creates autogenous crushing portions, impact crushing portions and/or semi-autogenous crushing portions on said crusher ring to allow the size and shape of said rock passing through said crusher to be precisely regulated.

7. The vertical shaft impact crusher described in claim 6 wherein said crusher ring is provided with equal proportions of breaker anvils to form impact crushing portions, and autogenous plates to form autogenous crushing portions in randomly alternating arrangement.

8. The vertical shaft impact crusher described in claim 6 wherein said selected sequence includes said autogenous plates and said breaker anvils alternating around said ring in regular arrangement.

9. The vertical shaft impact crusher described in claim 6 wherein said autogenous portions are also provided with anvils in said impact breaker anvil brackets to form semi-autogenous crushing portions.

10. The vertical shaft impact crusher described in claim 9 wherein said annular cover plate ring may be provided in segments which corresponds to said autogenous portions.

11. The vertical shaft impact crusher described in claim 10 wherein said autogenous segments are provided with anvils in said impact breaker anvil brackets to form semi-autogenous crushing portions.

12. The vertical shaft impact crusher described in claim 9 wherein said crusher ring is secured to said inside surface of said housing in a vertically adjustable manner.

13. The vertical impact crusher described in claim 9 wherein said autogenous plates extend closer to said rotor than do said breaker anvils.

14. A vertical shaft impact crusher comprising:

a housing having an outside surface, an inside surface and a cover plate with an underside provided with a segmented vertically depending annnular ring;

a rotor mounted within said housing for rotation about a central vertical axis and designed to receive axially-fed rock and propel it outwardly towards the inside surface of said housing;

means for rotating said rotor about said axis;

an annular crusher ring secured to the inside surface of said housing in a vertically adjustable manner, said crusher ring defining a circle;

a plurality of impact breaker anvil brackets positioned in a horizontal plane upon said crusher ring, each of said brackets having at least one leg, each leg with two ends, each leg being fastened at one end to and extending inwardly from said crusher ring on a secant to the circle defined by said crusher ring and each said second end being connected to a notched cross arm;

a plurality of impact breaker anvils positioned in selected ones of said cross arm notches to receive and fragment rock thrown by said rotor;

a plurality of autogenous plate retaining brackets secured to and regularly spaced about said crusher ring beneath said anvil brackets, each of said plate retaining brackets including a pair of spaced, inwardly projecting radial portions, each of said portions being supported by a vertically projecting gusset having an inside, an outside, and a pair of vertically projecting locating lugs, each gusset being secured along a vertical edge thereof to said ring;

a plurality of autogenous plates, each having an upwardly projecting lip on one edge and a pair of notched lateral edges, said notches of said notched lateral edges engaging said locating lugs, said plates extending horizontally inwardly towards said rotor to create a rock retaining ledge for autogenous crushing when releasably placed in said plate retaining brackets;

wherein the exact sequence of autogenous plates and breaker anvils around said ring creates autogenous, semiautogenous, and/or impact crushing portions on said crusher ring.

15. A crusher ring for a vertical shaft impact crusher, said ring comprising a plurality of segments, and defining a circle, each of said segments containing at least one anvil retaining bracket having at least one leg, each leg with two ends and being attached at one end to and extending inwardly from a segment on a secant to the circle defined by said ring, each said second end being connected to a notched cross arm, and an autogenous plate retaining bracket having an annular portion and a pair of spaced, inwardly projecting radial portions defining said segments, each of said radial portions being supported by a vertically projecting gusset secured along a vertical edge thereof to its corresponding segment.

16. The crusher ring described in claim 15 wherein said segments are arranged so that every other segment is provided with an anvil in said anvil retaining bracket, and the remaining segments are each provided with an autogenous plate in said autogenous plate retaining bracket.

17. The crusher ring described in claim 15 wherein approximately a first half of the number of said segments is provided with anvils in said anvil retaining brackets and a second remaining half of the number of said segments is provided with autogenous plates in said autogenous plate retaining brackets.

* * * * *